United States Patent [19]

Satake

[11] 4,323,006

[45] Apr. 6, 1982

[54] WHITENING APPARATUS FOR SUPER-GLOSSY WHITE RICE

[75] Inventor: Toshihiko Satake, Higashihiroshima, Japan

[73] Assignee: Satake Engineering Co., Ltd., Tokyo, Japan

[21] Appl. No.: 819,812

[22] Filed: Jul. 28, 1977

[30] Foreign Application Priority Data

Aug. 9, 1976 [JP] Japan ..... 51/95190

[51] Int. Cl.[3] ..... B02B 1/04; B02B 3/12

[52] U.S. Cl. ..... 99/519; 99/524; 99/528; 99/605; 99/617

[58] Field of Search ..... 99/516, 518, 520, 525, 99/612–614, 519, 524, 528, 605, 617; 426/482–483, 461–507, 511

[56] References Cited

U.S. PATENT DOCUMENTS

| | | | |
|---|---|---|---|
| 728,604 | 5/1903 | Overbeck | 99/525 |
| 736,264 | 8/1903 | Jeffers | 99/521 |
| 3,401,731 | 9/1968 | Wayne | 99/518 |

*Primary Examiner*—Philip R. Coe
*Assistant Examiner*—Timothy F. Simone
*Attorney, Agent, or Firm*—Norbert P. Holler; Marcus J. Millet

[57] ABSTRACT

Disclosed is the improvements in whitening apparatus for producing strongly glossy white rice without using any gloss additive. The improved apparatus wherein: friction between half-finished white rice grains which have been moistened while being supplied to a whitening chamber of the apparatus is caused by the rotation of a whitening roll axially disposed in a perforated bran-removing and whitening cylinder, said roll and said cylinder are defining therebetween said whitening chamber, whereby the surfaces of grains are fully cleaned of bran which is constantly discharged through the perforated wall of said cylinder, thereby enabling to expose hard portions of white rice grains devoid of bran. The ratio between the length and diameter of said cylinder experimentally substantiated for best results may be between 2:1 to 20:1.

5 Claims, 2 Drawing Figures

WHITENING APPARATUS FOR SUPER-GLOSSY WHITE RICE

Figure 1:
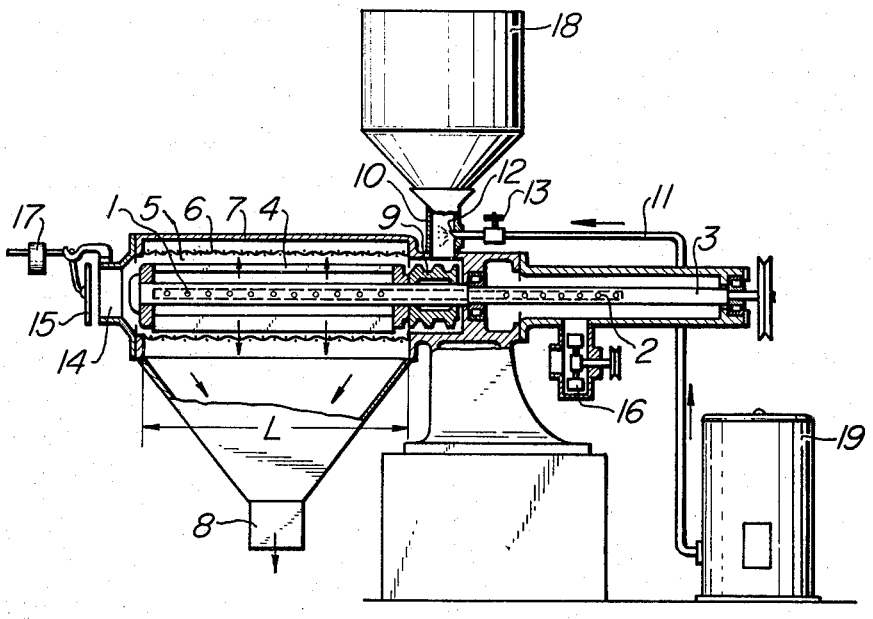

The present invention relates to improvements in rice whitening apparatus. The apparatus is devised and developed to obtain super-glossy white rice without using any gloss additive, which has heretofore been considered impossible to obtain unless a gloss additive such as talc is added or applied.

The object of the present invention resides in that a white rice material which has been whitened to less than 95% of the whitening yield rate against brown rice is supplied to a whitening chamber in a moistening rice whitening machine, said chamber being composed of a perforated bran-removing and whitening cylinder and a whitening roll rotatably mounted in said cylinder, a very small amount of moisture momentarily applied to the surface of rice grain moistens the surface of rice grain and softened chiefly the surface of grain, and the surface of rice grain is so thoroughly wiped and cleaned that even the aleuron layer thereof can be removed, the removal of which has been regarded as almost impossible heretofore, thereby enabling to obtain white rice having a glossy surface. In other words, it is the essential requirement that the surface of rice grain is softened, moist bran produced through friction between grains is removed from the perforated bran-removing and whitening cylinder to the outside of the whitening chamber upon the production thereof, and the bran thus produced is prevented from being attached to the surface of rice grain again.

The exposed hard surface of rice grain is wiped, polished and smoothed through the agency of a very small amount of moisture slightly remaining on the surface of rice grain and through friction between grains, whereby super-gloss is rendered to the surface of rice grain to a great extent. While the softened outer skin of rice grain is continuously subjected to friction and bran removal process as described above, eventually a hard portion is exposed on the surface of white rice grain so as to form a foundation for smooth surface, so that a smooth and super-glossy surface devoid of powdered bran can be formed through the polishing action. However, in order for the surface of rice grain to attain such a finely polished condition, said continuous process consisting of friction whitening and bran removal is required to have the length of a certain ratio. The following table of comparison experimentally substantiated that it is the essential requirement that, for this process of attaining super-gloss, the shortest length of the perforated bran-removing and whitening cylinder should be at least more than twice and at most less than 20 times the largest diameter thereof.

Table of comparison on the characteristics of various ratios between the length and diameter of perforated bran-removing and whitening cylinder

| Cylinders under test | HP | L Shortest length of whitening cylinder (mm) | D Largest diameter of whitening cylinder (mm) | L/D | Characteristics of the produced rice |
|---|---|---|---|---|---|
| A | 7 | 224 | 152 | 1.47 | Coarse surface; bran-attached; not glossy |
| B | 10 | 296 | 151 | 1.96 | Coarse surface; bran-attached; not glossy |
| C | 15 | 241 | 178 | 1.35 | Coarse surface; bran-attached; not glossy |
| D | 30 | 438 | 222 | 1.97 | Coarse surface; bran-attached; not glossy |
| E | 1 | 135 | 66 | 2.05 | Smooth surface; no bran; glossy |
| F | 2 | 224 | 78 | 2.87 | Smooth surface; no bran; glossy |
| G | 30 | 736 | 178 | 4.13 | Smooth surface; no bran; glossy |
| H | 10 | 702 | 117 | 6.0 | Smooth surface; no bran; glossy |
| I | 10 | 877.5 | 117 | 7.5 | Smooth surface; no bran; glossy |
| J | 12 | 1058 | 117 | 9.0 | Smooth surface; no bran; glossy |
| K | 15 | 1872 | 117 | 16.0 | Smooth surface; no bran; glossy Vibrations tend to occur due to insufficient strength of journalling of whitening roll shaft |

Once gloss has been attained on the surface of white rice grain as described above, the technical gist of the present invention is achieved. In the processes thereafter, even if the frictional action in the whitening chamber is performed intermittently, the surface of white rice grain will not resume a coarse surface and the gloss will not disappear because the hard portion is exposed on the surface of white rice grain. If, for example, the shortest length of the perforated bran-removing and whitening cylinder according to the present invention is less than twice the largest diameter thereof, the moistened rice grains are discharged halfway of their whitening and debraning process to the outside of the whitening chamber, and hence the applied moisture is dried out immediately, the action according to the present invention is discontinued and no effect is obtained even if the period of the fricional action in the whitening chamber is extended again. Or, if said ratio is increased more than 20 times, the temperature of rice grains becomes more than 50° C. (as against the temperature of brown rice of 20°

C.), i.e., the temperature of rice grains is increased by almost 30° C., and there is a danger of producing lowered quality of rice leading to change of the taste for worse. Then, if cooled air is used in this case, cracks will be caused to the rice grains. Accordingly, an increase in the amount of air blow for cooling should necessarily be limited. Consequently, it is concluded that the substantial upper limit in the ratio of the length to the diameter of said whitening cylinder should be determined. Additionally, in said whitening cylinder having the ratio of more than 20 times, partial changes in load pressure take place, load is liable to be unstable, fitful overload phenomena occur, troubles of unexpected interruption in operation tend to take place, and additionally broken rice is produced, whereby the yield rate will be decreased. In any case, if the length of whitening cylinder is extremely large as compared the inner diameter thereof, rice grains are excessively whitened. In case the length of whitening cylinder becomes nearly 20 times the diameter thereof while using a whitening roll of a predetermined diameter, the structural strength of a main shaft of the whitening roll and the like reaches its limitation in respect of diameter, becoming unfit for practical use. Accordingly, it is regarded as practically useless to extend the length of the whitening chamber more than twenty times the diameter thereof.

Additionally, in the embodiment which will be described hereunder, the moistening device according to the present invention is constructed such that a nozzle of water supplying pipe is provided at a rice feed port. However, such a construction may be adopted that mist of water or the like is supplied to the whitening chamber through vent holes provided in the outer peripheral wall of the whitening roll.

Further, in the above-mentioned embodiment, for moistening, water liquid is directly used. However, moist air or water vapor may be utilized when necessary.

In order to realize the present invention, four requirements are essential which include a certain amount of moisture applied, a certain period of time for water permeation, a certain period of time for continuous frictional action and a certain period of time for bran removal. Continuous frictional action and bran removing action are constantly required, and even momentary drying of the surfaces of rice grains during the process will result in a vital failure as aforesaid.

Additionally, when the same white rice passes through the whitening chamber meeting the requirements of the gist of the present invention a plurality of times, a very small amount of water may be supplied to the whitening chamber everytime as necessary.

The present invention contemplates to provide a whitening apparatus for super-glossy white rice, characterized in that a moistening device communicated with a whitening chamber composed of a perforated bran-removing and whitening cylinder and a whitening roll rotatably mounted in said cylinder, and the length of the shortest portion of said whitening cylinder is at least more than twice and at most less than 20 times the diameter of the largest portion thereof.

Description will hereunder be given of the present invention with reference to the embodiment shown in the drawings.

Figure 2:
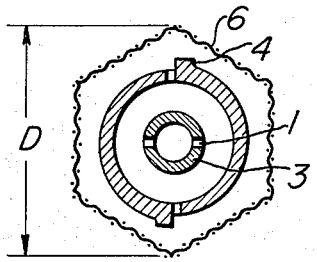

FIG. 1 is a cross-sectional side view showing one embodiment of the present invention; and FIG. 2 is a longitudinal cross-sectional view of the essential portion thereof.

In the whitening apparatus shown in FIGS. 1 and 2, a main shaft (3) of air supplying pipe having air-blow holes (1) and air-intake holes (2) is rotatably mounted, an air-blow friction type whitening roll (4) is fixedly mounted on said main shaft (3), said whitening roll (4) is surrounded by a perforated bran-removing and whitening cylinder (6) secured to the whitening apparatus to thereby define a whitening chamber (5) therebetween, further a cover (7) surrounding said perforated bran-removing and whitening cylinder, and said cover (7) is provided at the lower end thereof with a bran discharge port (8). Coupled on to the main shaft (3) is a transfer roll (9) disposed adjacent to said whitening roll, provided above said transfer roll (9) is a rice feed port (10), open to said rice feed port (10) is a nozzle (12) of water supplying pipe (11), and provided in said water supplying pipe (11) is a control valve (13). Open to the whitening chamber (5) on the side opposite to said transfer roll is a rice discharge port (14) having a pressure cover (15). Designated at (16) is an air blower for supplying pressurized air into air intake holes (2) formed in the main shaft (3), (17) a weight for adjusting the pressure applied by the pressure cover (15) to the material in the whitening chamber, (18) a hopper, and (19) water supplying means including a water tank and a pump. As apparent from the drawing, the shortest length L of whitening cylinder (6) is more than twice the largest diameter D of the whitening cylinder.

When the main shaft (3) and the air blower (16) are driven, a white rice material which has been whitened to less than 95% of the whitening yield rate against brown rice is fed to the rice feed port (10) and at the same time a proper amount of water controlled by the control valve (13) is applied to the white rice material from the nozzle (12), the white rice material thus moistened is fed to the whitening chamber (5) by the transfer roll (9), the white rice material is subjected to whitening action through friction between grains and air blow as the whitening roll is rotated, and polishing action through friction between white rice grains is continued until the hard portions of white rice grains devoid of powdered bran are exposed while the discharge of the produced bran is performed from the perforated bran-removing and whitening cylinder (6), whereby glossy and beautiful white rice is produced and then discharged through the rice discharge port (14).

The present invention presents by making the length of bran-removing and whitening cylinder more than twice and less than 20 times the diameter thereof so that moistening-frictional whitening process is turned into a reasonable one, such a remarkable effect to produce strongly glossy white rice devoid of powdered bran, and especially enabling to fully remove even the aleuron layer which is difficult to remove in the conventional apparatus.

What is claimed is:

1. A whitening apparatus for super-glossy white rice comprising a perforated bran removing and whitening cylinder, a whitening roll rotatably mounted in said cylinder and extending generally coaxially therewith so that said cylinder and said roll define a whitening chamber therebetween, means for rotating said roll, means for introducing rice into said chamber at a first end of said cylinder, means for removing rice from said chamber at a second end of said cylinder opposite from said first end while maintaining a pressure on the rice within said chamber, and means for moistening the rice to be whitened, the shortest length of said cylinder being more than twice but less than twenty times the largest diameter of said cylinder.

2. An apparatus as claimed in claim 1 wherein said roll is an air blow friction type whitening roll, further comprising means for supplying air to the interior of said roll.

3. An apparatus as claimed in claim 2 wherein said means for rotating said roll includes a shaft and said roll is affixed to said shaft for rotation therewith.

4. An apparatus as claimed in claim 3 wherein said means for introducing rice into said chamber includes a transfer roll affixed to said shaft for rotation therewith adjacent to said first end of said cylinder.

5. An apparatus as claimed in claim 2, wherein said means for removing rice from said chamber includes a portion of said cylinder at said second end thereof defining a port and a pressure cover associated with said port.

* * * * *